United States Patent [19]

Taubert et al.

[11] Patent Number: 4,561,277

[45] Date of Patent: Dec. 31, 1985

[54] METHOD OF MAKING SCREWS AND DIES THEREFOR

[75] Inventors: Hubert Taubert; Rudolf Webendoerfer, both of Neuwied, Fed. Rep. of Germany

[73] Assignee: Conti Fasteners AG, Zug, Switzerland

[21] Appl. No.: 646,255

[22] Filed: Aug. 29, 1984

[30] Foreign Application Priority Data

Sep. 9, 1983 [DE] Fed. Rep. of Germany ..... 3332570

[51] Int. Cl.[4] ..... B21H 3/04; B21D 17/00

[52] U.S. Cl. ..... 72/88; 10/10 R; 10/152 R; 72/365; 72/469

[58] Field of Search ..... 10/10 R, 152 R, 152 T; 72/90, 88, 365, 469, 470

[56] References Cited

U.S. PATENT DOCUMENTS 3,180,126 4/1965 Carlson .
3,246,556 4/1966 Phipard, Jr. .
3,530,920 9/1970 Podell ..... 10/10 R
3,852,992 12/1974 Yamamoto ..... 72/469
3,875,780 4/1975 Cochrum et al. .
4,040,328 8/1977 Muenchinger ..... 72/88
4,170,050 10/1979 Bosse .
4,315,340 2/1982 Veldman ..... 72/88
4,353,233 10/1983 Chapman .

FOREIGN PATENT DOCUMENTS 2929008 2/1981 Fed. Rep. of Germany .

*Primary Examiner*—W. D. Bray
*Attorney, Agent, or Firm*—Trexler, Bushnell & Wolters, Ltd.

[57] ABSTRACT

Method and dies for threading a screw comprises providing a screw blank with a portion of its length of lobular cross section and an adjacent portion of the blank of circular cross section. The blank is rolled between roll dies so as to roll the thread on the circular portion and simultaneously roll the thread at the lobes only on the lobular portion. Thereafter, the blank is rolled to additional regions of the dies wherein the thread is rolled to form on the lobular section, while the cylindrical section passes through regions of clearance or relief on the dies.

9 Claims, 15 Drawing Figures

METHOD OF MAKING SCREWS AND DIES THEREFOR

BACKGROUND OF THE INVENTION

This invention relates to a method of manufacturing screws, such as self-threading screws or locking screws, and to thread-rolling dies suitable for the manufacture of such screws.

A type of screw particularly suitable for manufacture by the method and dies of the present invention is one which contains a known trilobular geometry of the thread body and with the thread having flank angles of 60°, but with the tips or crests of the threads having flank angles of 30°. Such a screw is commonly referred to as a 60°/30° locking screw. In a nut or threaded hole in steel, aluminum or other appropriate work material, a thread of the foregoing type secures itself by reason of the fact that the prevailing torque of the lobular thread form at the tolerance-free 30° flank provides such a high prevailing torque that the thread does not loosen through vibration. However, the screw does not provide a seal against the seepage of liquids, such as water, hydraulic fluids, and the like.

Another known screw is of the type which swages its threads in a ductile workpiece material without forming chips, and is constructed in such a way that the thread is of a standard configuration in profile, namely a thread body with flank angles of 60°. Typically in such a screw, the first few threads from the tip are of progressively increasing size (i.e., tapered) and merge into a trilobular holding section which, when engaged with the workpiece, has a substantial prevailing torque, but not a liquid tight seal.

Furthermore, there is a recently known screw which not only swages its own chip free thread in a workpiece, but also provides a seal between the screw thread and the thread so formed such that no liquid, even under pressure, can seep across the thread. A self-forming and self-sealing screw of the foregoing type is basically one which contains a trilobular threaded body part at the entrance end of the screw and an adjacent threaded part of circular configuration which is capable of engaging the workpiece hole without clearance so as to form the thread seal thereat.

OBJECTS AND SUMMARY OF THE INVENTION

It is an object of the present invention to provide an economical method of manufacturing screws of the foregoing type, particularly self-sealing screws, although the method may be applicable to other types of screws of lobular form.

A further object of this invention is to provide a pair of thread-rolling dies for manufacturing the screws of the foregoing type wherein the dies are constructed so that the die couple will roll the lobular screw blanks in one stroke.

A still further object of this invention is to provide a method and dies of the type stated which result in accurate alignment of the screw blank during the thread-rolling process.

In accordance with the foregoing objects, the method comprises a procedure suitable for screws of the type having a portion of its length of circular cross section and an adjacent portion of its length of lobular cross section. The method comprises providing a screw blank with a circular cross section over a portion of its length and an adjacent portion of its length with a lobular cross section of the type having circumferentially spaced lobes separated by intermediate arcuate sides of larger radius than the radius of the lobes, rolling the blank between thread-rolling dies so as to roll a thread on the blank portion with circular cross section and simultaneously roll on the lobular section a thread that is less developed than the thread on said length of circular cross section, but with the thread at the lobes being regions where the thread on the lobular section has its maximum development, thereafter rolling the thread on the lobular section to a further development while passing the length of circular cross section into regions of relief on the dies.

In further accordance with the present invention, there is provided a thread-rolling die couple comprising a first thread-rolling section on each die, each first section having thread-forming generally longitudinal ridges and grooves, a second die section on each die, each second section having generally longitudinal thread-forming ridges and grooves, the ridges and grooves of the second section of one die being raised relative to those of the other die, the second section also having relief areas which are depressed relative to the ridges and grooves on the first sections, and a transition region between each of said first and second sections and providing ramps of opposite angles.

As previously stated, the invention is primarily concerned with rolling thread on a blank to produce a screw which is partially lobular in form and partially circular in form. The lobular form, preferably of trilobular configuration, has equally spaced lobes separated by intervening sides. In the geometry of the lobular form, the lobular cross section has a constant width D throughout 360°, and the lobular form may be inscribed within a circle having a diameter C, and with the difference C-D equal to the value K, which is the amount of out of round of the lobular form.

With this geometry in mind, the method may comprise forming a bolt blank produced in any suitable manner as by a cold extrusion press. The bolt blank has a trilobular form of the type stated and an adjacent portion of circular cross section. The blank is rolled between a die couple consisting of a short moving threaded die and a long fixed rolled die with the rolled dies facing each other so that the thread-forming surfaces of the dies will exercise thread-forming pressure and cold form the threads. The manner of rolling consists of forming the circular thread on the circular blank portion while simultaneously forming the thread on three high points of the trilobular section of the blank, namely those peak portions of the blank at which the lobes are located. Thereafter, the trilobular portion with its partially rolled thread is gripped by the thread-rolled dies in a second region wherein the dies in the region of the lobular form are moved closer together by an amount K so that the effective thread rolling takes place across uniform width D. The result is that the originally partially rolled lobular form is rolled out to full development. Meanwhile, as the lobular portion of the blank is being rolled out to full development, the circular portion of the blank rolls into relief areas in the dies.

DETAILED DESCRIPTION

Figure 1:
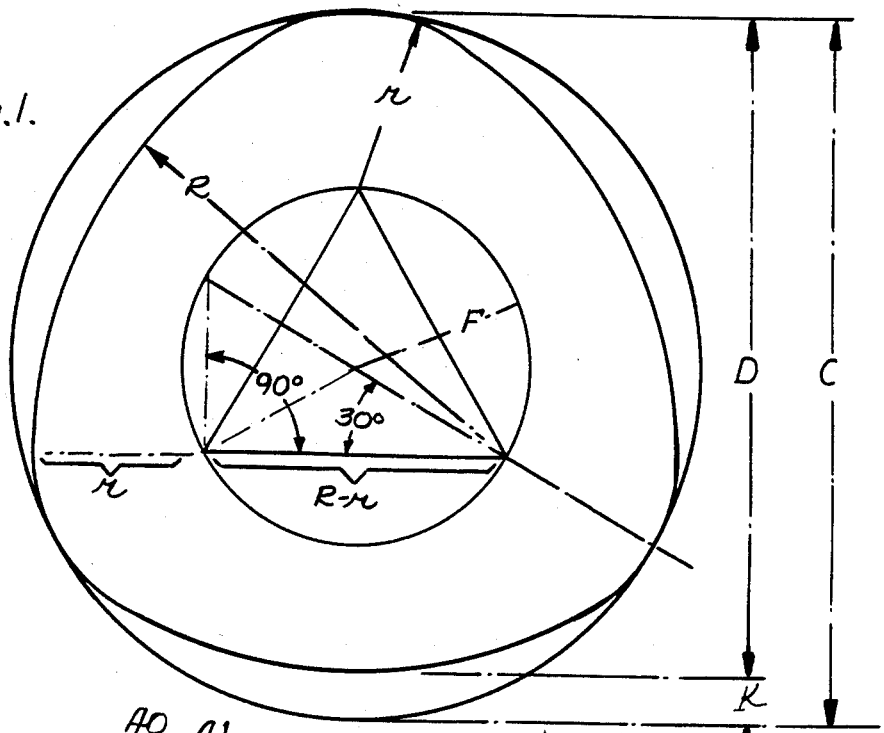
FIG. 1 is a diagram showing the basic geometrical considerations applicable to screws manufactured in accordance with the present invention and dies.

Referring now to FIG. 1, there is shown the basic geometrical form as utilized in the method of the present invention. The form is known in the art, but suffice it to say that it is constructed around a basic equilateral triangle having a circumscribing circle of radius F. Three lobes are shown, each having a radius r and which radius is centered at each proximate apex of the triangle. The sides intermediate the lobes have a radius R which is centered at a remote apex of the triangle. The arrangement provides for a width D of the lobular form which is uniform throughout 360° and a circumscribing circle having a diameter C. The difference between C and D is equal to K, the amount of out of round. C may also be expressed as $2(F+r)$. Additionally, F may be recited as equal to 3.732K. The trilobular form has been found to be most useful commercially, although a lobular form with a greater or lesser number of lobes, particularly an odd number of lobes, may be utilized.

Figure 2:
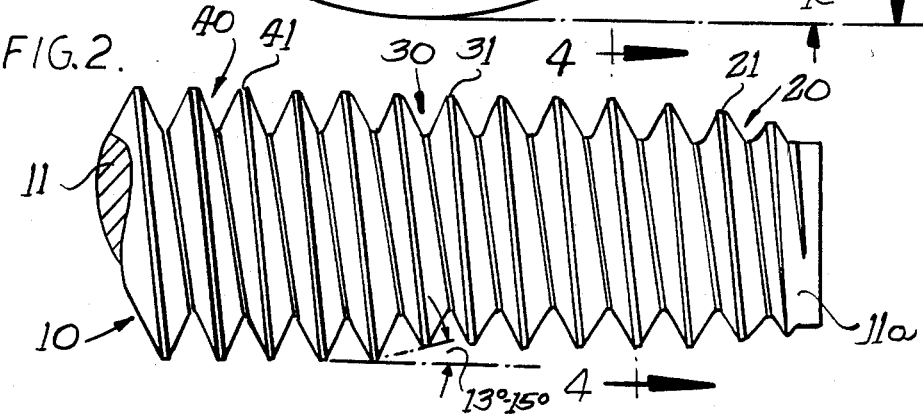
FIG. 2 is a fragmentary side elevation of one form of sealing screw that can be manufactured in accordance with the dies and method of the present invention.
Figure 3:
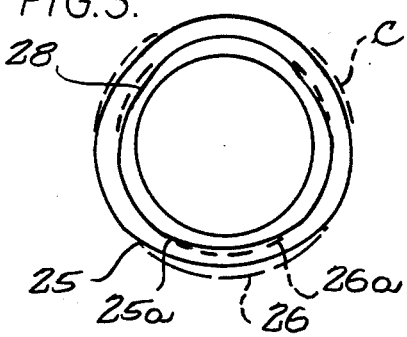
FIG. 3 is a front end elevation of the screw of FIG. 2 and showing thread crests and circumscribing circles.
Figure 4:
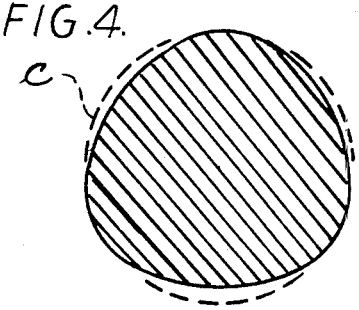
FIG. 4 is a sectional view taken approximately along line 4—4 of FIG. 2.

Referring now to FIG. 2, there is shown a screw 10 comprising a shaft or shank 11 with a tip or front end 11*a*. The screw 10 shows a first thread section 20 on the screw shank, the thread section 20 being of trilobular form. The trilobular thread form includes trilobular thread turns 25, 25*a* (FIG. 3) which have associated circumscribing circles 26, 26*a*. The circumscribed circle diameter of the screw thread enlarges from the tip or end 11*a* toward the other end of the screw shank. This trilobular form has three high points, each at 120° on the circumference, together with sides or regions of relief 28 intermediate the lobes.

Figure 5:
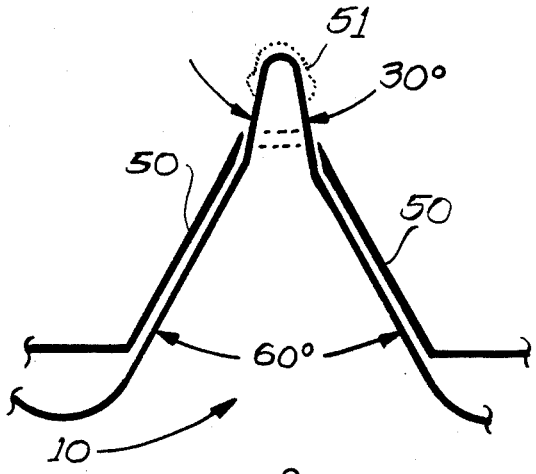
FIG. 5 is an enlarged diagrammatic view of the thread of FIG. 2.

The threads have normal flank angles of 60°; however, their crests or tips are provided with 30° flank angles as best shown in FIG. 5.

Adjacent to the thread segment 20 is a thread segment 30 also of trilobular geometry. However, the segment 30 has a crest which remains constant for the segment 30, namely the segment 30 has a constant diameter inscribing circle C. The thread itself has a flank angle of 60°, while the tips 31 have a flank angle of 30°, as shown in FIG. 5.

Continuing from the thread segment 30 is a further thread segment 40 of circular cross section. The thread of the thread section 40 also exhibits flank angles of 60°, while the thread tips 41 have flank angles of 30°.

The two thread segments 30 and 40 merge into each other under an inclining angle shown in FIG. 2. More particularly, the outer diameter of the thread segment 40 of circular changes through an inclining angle of 10°–20° (preferably 13°–15°) from the outer diameter of the thread segment 30 over to the adjacent trilobular threaded geometry on the segment 30.

FIG. 5 shows a counter thread 50 in a workpiece which is formed by any suitable method. The counter thread is cold worked in the thread tip area as at 51 to enhance its locking effect.

It will be apparent that the screw 10 can utilize thread flank angles other than 60°/30°. For example, 60°/40° or 60°/20° or other angles may be used.

Figure 6:
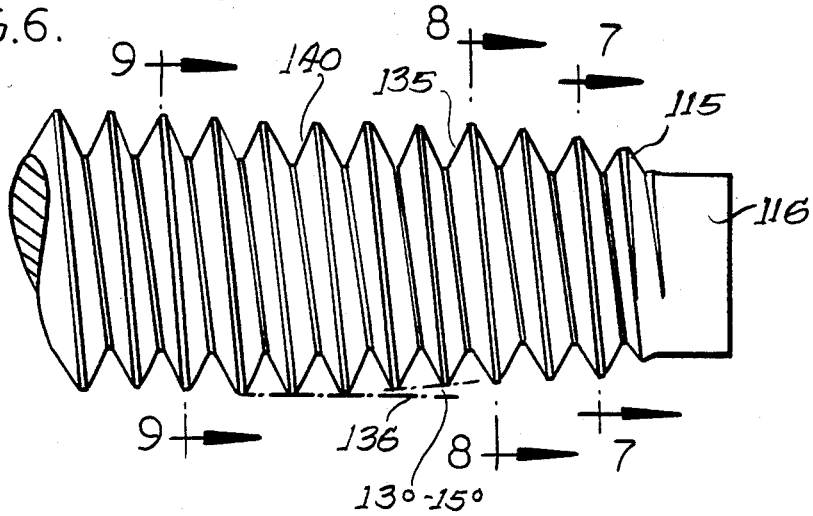
FIG. 6 is a fragmentary elevational view of another form of screw which can be manufactured by the method and dies of the present invention.
Figure 7:
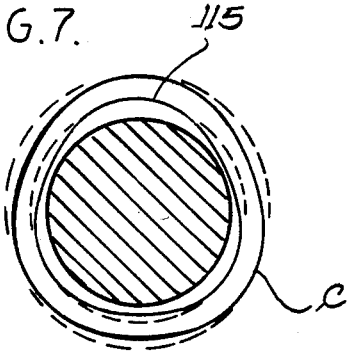
FIGS. 7, 8 and 9 are sectional views taken along lines 7—7, 8—8 and 9—9, respectively, of FIG. 6.
Figure 8:
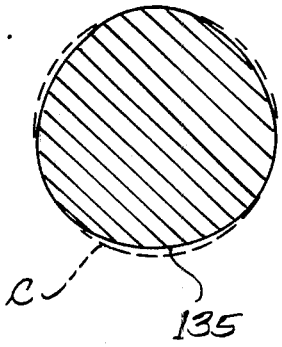
Figure 9:
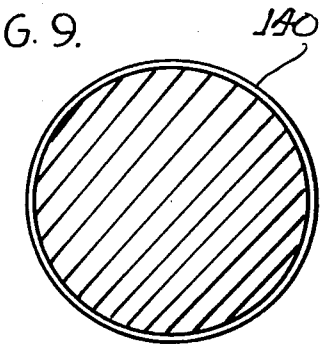

FIGS. 6–9 show a thread-forming screw which has an end 116 and a first threaded section 115 comprising two to four threads of trilobular geometry. The threads taper such that there is an enlarging circumscribing circle diameter C from the screw tip 116 toward the opposite end of the screw body. Section 115 merges with a threaded section 135. The threaded section 135 has one or several turns of trilobular thread form with constant diameter circumscribing circles, and the threaded segment 135 joins a further thread segment 140 with a circular thread cross section, as best seen in FIGS. 6 and 9. The thread of the segment 140 with circular thread geometry has a preferred flank angle of 60°.

The two threaded segments 135 and 140 merge into each other under an angle 136 of 10°–20°, and preferably about 13°–15°.

The screw of FIGS. 6–9 may alternatively exhibit a thread flank angle of 30°, 40° or 50°. In addition, the geometry of the thread body can be formed such that instead of the trilobular form four lobes, each at 90°, or two lobes, each at 180°, can be provided with a transition from the lobes to the circular geometry as described. Furthermore, the screw may be constructed with a non-standard high point or crest configuration.

Figure 10:
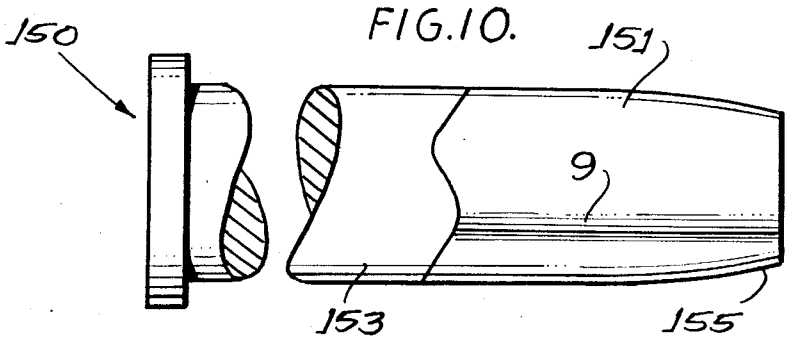
FIG. 10 is a fragmentary side elevational view of a screw blank used to carry out the method of the present invention.
Figure 12:
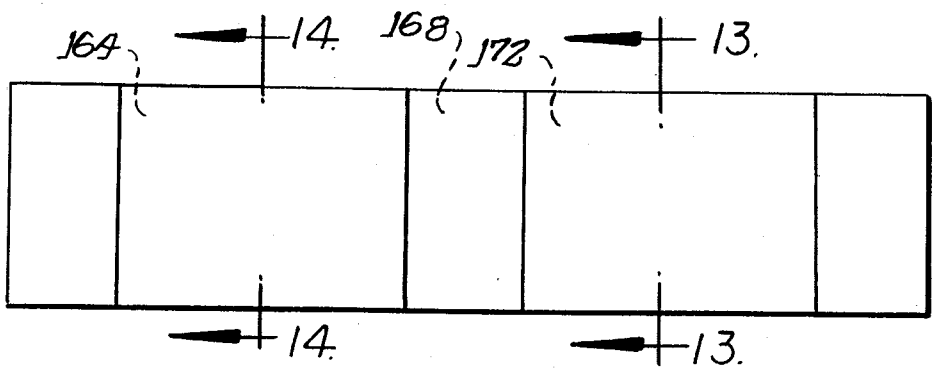
FIG. 12 is a top plan view of the thread-rolling die couple which forms part of the present invention.
Figure 11:
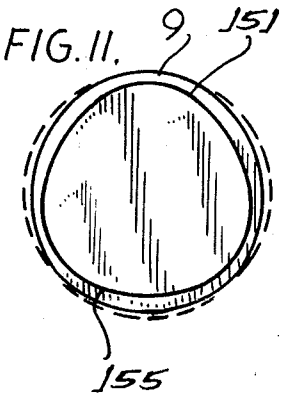
FIG. 11 is a front elevational view of the screw blank of FIG. 10.

The method of the invention utilizes a screw or bolt blank which may have the characteristics of the blank 150 shown in FIG. 11. The bolt body is preferably formed by an extrusion process to provide the C and D dimensions on the trilobular bolt section 151. The remaining bolt section 153 is of circular cross section. The lobular bolt section 151 merges into the cylindrical bolt section 153 through a transition region shown in FIG. 10. Furthermore, the free end of the bolt section 151 is provided with a taper 155.

The bolt blank 150 is rolled between a die couple comprising thread-rolling dies shown in FIGS. 12–15 which roll a thread of uniform pitch. Generally speaking, the cylindrical portion 153 of the bolt flank is thread-formed, while at the same time the three high points or lobes on the trilobular sections are also lightly rolled, which results in a partially formed thread over the trilobular section 151. Thereafter, the bolt blank is rolled to another region of the dies where the lobular section is thread-rolled to full thread development, while at the same time the circular section 153 is moved through regions of clearance on the dies. The dies 160, 161 shown are for making the screw of FIGS. 6–9; however, by altering the shape of the thread-forming die grooves in appropriate places to the 60°–30° form, the thread of FIGS. 2–5 may be made.

Figure 13:
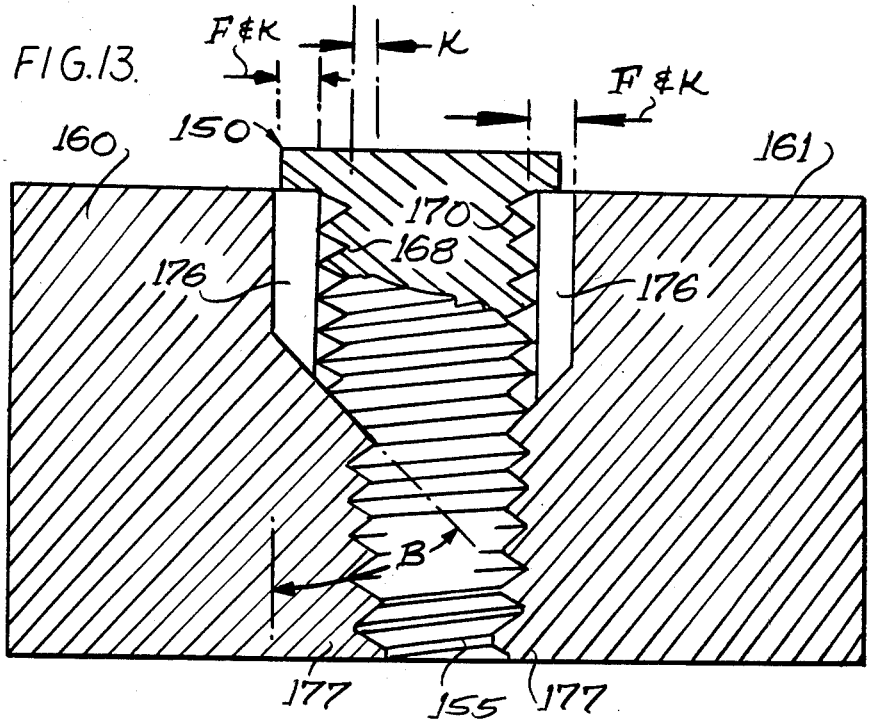
FIG. 13 is a sectional view taken along line 13—13 of FIG. 12.
Figure 14:
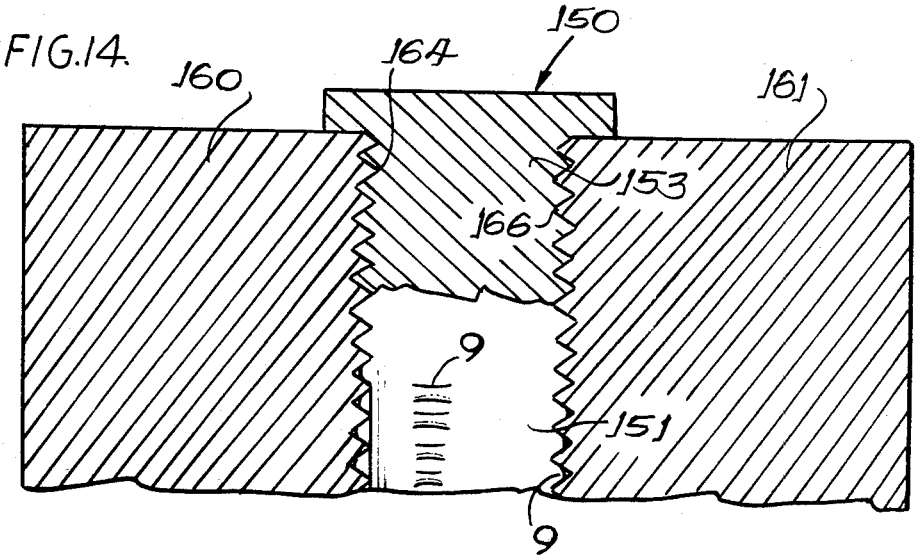
FIG. 14 is a sectional view taken along line 14—14 of FIG. 12.
Figure 15:
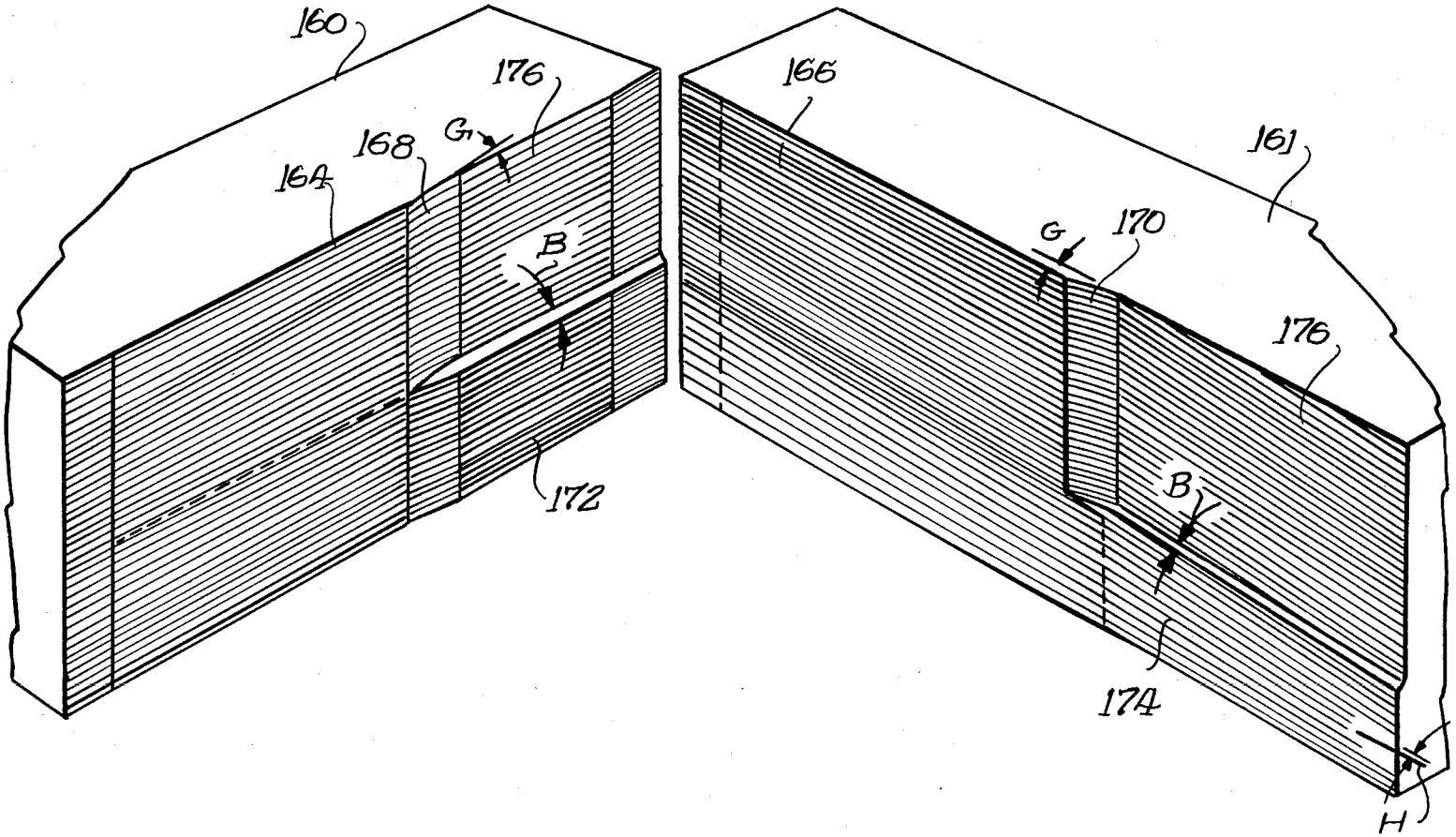
FIG. 15 is a perspective view showing the fixed and moving roll dies constituting the die couple of the present invention.

The die couple comprises a fixed die 160 and movable die 161. The dies 160, 161 are machined to provide the usual ridges and grooves over the die faces. The ribs and grooves are at the helix angle H. Conventional lead-on and lead-off portions are ground on the dies 160, 161. The fixed die 160 has a first region 164 with thread-forming ridges and grooves that cooperate with a first region 166 on the movable die 161. In the die regions 164, 166, the cylindrical blank portion 153 and the lobular blank portion 151 are rolled simultaneously (FIG. 14), but the lobular section 151 is threaded only at its lobes 9. The thread at the cylindrical section 153 is substantially fully formed. Also as shown in FIG. 13, the lower ends of the dies may be formed with ramps 177 for producing a tapered thread on the lead 155 of the blank. If the 60°–30° thread of FIG. 5 is being rolled, these ramps 177 are eliminated and a partially formed thread is formed on the tapered blank point.

After rolling the blank through the sections 164, 166, the rolling action of the dies then shifts the blank to transition ramps or zones 168, 170 on the fixed and movable dies, respectively, in order to prepare the blank for threading further on the lobular portion 151. Each transition zone is at an angle G to the plane of the die face and is about 5°. A ramp section is formed on the fixed die in the part of the transition zone 168 over which the thread is raised by an amount K, as will hereafter be described. In end elevation or cross section (FIG. 13), this ramp section has an angle B of about 13° to 15° representing an angle that is the same as the transition angle between the lobular and circular forms, as shown in FIG. 6.

Thus, the blank is rolled from the transition zone into a second zone or region 172, 174 of each die for final fully developed threading of the trilobular section of the blanks. The thread formed at the lobes of the blank during the threading operation in the regions 164, 166 provides a threaded length that is guided by the ridges and grooves on the transition zones 168, 170. These conditions cause the blank to be guided properly into the second regions 172, 174, so that the blank is properly centered or otherwise aligned for accurate threading in terms of pitch and other geometry.

When the blank is in the regions 172, 174, the blank will be as shown in FIG. 13. Comparing FIG. 13 with FIG. 14, where the blank is in the first regions 164, 166, it will be noted that in FIG. 13 the threads in the lower part of the fixed die 160 are closer to the opposing threads in the movable die 161. This displacement of the threads occurs gradually over the transition region 168 and results in a raising or displacement of the thread in an amount equal to K, as previously defined herein. The displacement is only on the fixed die 160, whereby the transition ramp 170 on the movable die 161 extends only part way across the width of the die 161 and to an extent equal to the width of the relief section 176. This width is normally the length of the cylindrical thread section (e.g., 140). The width of the transition region 168 on fixed die 160 is across the full width of the die 160, the upper part of region 168 being of a width that is the same as that of region 170 and the lower part of the region 168 is the ramp that shifts the working face of the die by the amount K. The full threading of the lobular portion 151 of the blank 150 is thus effected by die sections that are spaced apart an amount equal to the distance D, namely the uniform width of the lobular form. No displacement is required of the thread of the movable roll die in the lobular threading region. The ramp configuration on the fixed die in the transition zone results in a transition angle on the finished screw from the lobular to the cylindrical sections of about 13°–15°. Due to a greater volume of metal per unit length of the round screw blank section 153 as compared to that in the lobular section 151, the C diameter of the circular section 140 of the being formed screw increases over the C diameter of the adjacent lobular section 135 during the rolling operation. This increase in the C diameter is controlled by the angle B. The circular portion of the screw (e.g., 140) becomes a sealing section of the screw when the latter is tapped into a workpiece.

In the regions 172, 174, relief sections 176, 176 are provided for receiving the already threaded cylindrical portion of the being-formed screw. These relief portions are an amount at least equal to F+K, the values F and K being as previously described. The reason for the regions of relief is that the circular section of the screw will undergo a side-to-side oscillating movement in an amount equal to K/2 from either side of the center line of the roll die face in the trilobular rolling sections (FIG. 13). The relief F+K is made to accommodate this cyclic movement.

We claim:

1. A method of making screws of a type having a portion of its length of circular cross section and an adjacent portion of its length of lobular cross section, comprising providing a screw blank with a circular cross section over a portion of its length and an adjacent portion of its length with a lobular cross section of the type having circumferentially spaced lobes separated by intermediate arcuate sides of larger radius than the radius of the lobes, rolling the blank between thread rolling dies so as to roll a thread on the blank portion with circular cross section and simultaneously roll on the lobular sections a thread that is less developed than the thread on said length of circular cross section but with the thread at the lobes being regions where the thread on the lobular section has its maximum development, thereafter rolling the thread on the lobular section to a further development while passing said length of circular cross section into regions of relief on said dies.

2. A method according to claim 1 in which the rolling of the lobular thread to further development is effected by passing the lobular section between die regions that are closer together than are the die regions that simultaneously roll the lengths of the lobular and circular cross sections.

3. A method according to claim 2 in which the dies are brought closer together by an amount K wherein K is defined as the out of round of said lobular form, the lobular form being of constant width D through 360°, the circle circumscribing the lobular form having a diameter C, and $K=C-D$.

4. A method according to claim 3 in which the relief regions on each die are greater than K wherein K is defined as the out of round of said lobular form, the lobular form being of constant width D throughout 360°, the circle circumscribing the lobular form having a diameter C, and $K=C-D$.

5. A method according to claim 3 in which the regions of relief on each die are at least F+K, wherein K is defined as in claim 3 and F is substantially 3.732K.

6. A thread rolling die couple comprising a first thread-rolling section on each die, each first section having thread-forming generally longitudinal ridges and grooves, a second die section on each die, each second section having generally longitudinal thread-forming ridges and grooves, the ridges and grooves of the second section of one die being raised relative to those of the other die, the second sections also having relief areas which are depressed relative to the ridges and grooves on the first sections, and a transition region between each said first and second sections and providing ramps of opposite angles over which a fastener blank is adapted to roll.

7. A die couple according to claim 6 in which the die couple has a movable die and a fixed die.

8. A die couple according to claim 6 in which the ridges and grooves in the second section of each die extend over a minor proportion of the width of the associated die.

9. A die couple according to claim 6 in which part of said transition region spans the gap between the first section and the relief area and another part of the transition region spans the gap between the first section and the ridges on said second section.

* * * * *